US005982080A

United States Patent [19]

Shibata et al.

[11] Patent Number: 5,982,080

[45] Date of Patent: Nov. 9, 1999

[54] SPARK PLUG AND ITS MANUFACTURING METHOD

[75] Inventors: Masamichi Shibata, Toyota; Yasushi Kawashima, Mie-ken, both of Japan

[73] Assignee: Denso Corporation, Kariya, Japan

[21] Appl. No.: 08/949,328

[22] Filed: Oct. 3, 1997

[30] Foreign Application Priority Data

Oct. 4, 1996 [JP] Japan ..... 8-264722
Oct. 7, 1996 [JP] Japan ..... 8-266374

[51] Int. Cl.[6] ..... H01T 21/02

[52] U.S. Cl. ..... 313/141; 313/144; 445/7

[58] Field of Search ..... 445/7; 313/144, 313/141

[56] References Cited

U.S. PATENT DOCUMENTS 4,684,352 8/1987 Clark et al. ..... 445/7
5,440,198 8/1995 Oshima et al. ..... 313/141

FOREIGN PATENT DOCUMENTS 537031 4/1993 European Pat. Off. .
545562 6/1993 European Pat. Off. .
31 32 814 4/1982 Germany .
4-242090 8/1992 Japan .
5-343159 12/1993 Japan .
5343159 12/1993 Japan .

*Primary Examiner*—Kenneth J. Ramsey
*Attorney, Agent, or Firm*—Pillsbury Madison & Sutro LLP

[57] ABSTRACT

A hole is formed on a central electrode. A chip has a leg portion. A distal end of the leg portion is entirely united with a bottom surface of the hole by resistance welding. A plurality of fused portions are formed at a boundary between the chip and the central electrode. The fused portions integrate the chip and the central electrode by fusing them together. Each fused portion extends in a radial direction of the chip. The entire periphery of a pointed end of each fused portion penetrates radially inside the outer cylindrical surface of the leg portion of the chip.

29 Claims, 7 Drawing Sheets

SPARK PLUG AND ITS MANUFACTURING METHOD

BACKGROUND OF THE INVENTION

1. Field of the Invention:

The present invention relates to a long-life spark plug which is preferably employed in a gas heat pump or a cogeneration engine.

2. Related Art:

FIG. 9 shows a conventional spark plug 110 disclosed in Unexamined Japanese Patent Application No. 5-343159, published in 1993. The spark plug 110 comprises a central electrode 103 made of an electrically conductive member such as Ni alloy, copper, or copper alloy. A chip 105 is connected to a front (top) end 103*a* of the central electrode 103 by laser welding. The chip 105 is made of an electrically conductive material, such as Ir alloy or Pt alloy, having a fusing point higher than that of the central electrode 103. The chip 105, disclosed in this prior art, comprises a leg portion 151 inserted in a hole 1321 provided on the front end portion 103*a* of the central electrode 103. A larger-diameter portion 152 is formed integrally with the leg portion 151. The larger-diameter portion 152 has a diameter of 1.8 mm which is larger than that of the leg portion 151.

The front end portion 103*a* of the central electrode 103 and the larger-diameter portion 152 of the chip 105 are brought into contact with each other at their abutting faces. By performing the above-described laser welding, a fused portion 107 is formed at the abutting faces of the front end portion 103*a* of the central electrode 103 and the larger-diameter portion 152 of the chip 105. In an axial direction of the chip 105 (i.e., in the up-and-down direction of FIG. 9), the upper half of the fused portion 107 penetrates into the region of the chip 105. The lower half of the fused portion 107 penetrates into the region of he central electrode 103.

The above-described spark plug 110 has been preferably employed in a gas heat pump or a cogeneration engine. The life of the gas heat pump or the cogeneration engine is longer than the life of a conventional automotive engine. Accordingly, when the spark plug 110 is used for the gas heat pump or the cogeneration engine, the life of the spark plug 110 needs to be long enough.

The inventors of the present invention have performed an evaluation on the above-described conventional spark plug 110 through a test conducted under simulated operating environments of a gas engine. According to the test result the chip 105 was detached or disengaged from the central electrode 103 during a duration shorter than the life of the gas engine. A crack was recognized at the boundary surface between the larger-diameter portion 152 of the chip 105 and the fused portion 107. It is believed that the above-described detachment or disengagement of the chip 105 was caused as a result of an advancement of this crack.

Hereinafter, the causes of the above-described problem will be explained based on the experimental result and study conducted by the inventors.

First, the central electrode 103 is constituted by a member whose thermal expansion coefficient is larger than that of a member constituting the chip 105. For example, the central electrode 103 is made of nickel alloy having a thermal expansion coefficient of approximately $13.3\times10^{-6}$[deg$^{-}$]. The chip 105 is made of Ir alloy having a thermal expansion coefficient of approximately $6.8\times10^{-6}$[deg$^{-}$]. When the spark plug 110 is used practically, the spark plug 110 is subjected to repetitive heating and cooling cycles causing temperature variations of approximately 900° C. Thus, a significant thermal stress is applied directly to or in the vicinity of the fused portion 107. Although the reason is not explicitly known, a bonding force between the fused portion 107 and the chip 105 is smaller than a bonding force between the fused portion 107 and the central electrode 103. Accordingly, the crack appears at the boundary surface between the fused portion 107 and the chip 105 due to the above-described thermal stress. And, the chip 105 removes or disengages from the fused portion 107.

Furthermore, according to the evaluation conducted by the inventors, it is found that there is a likelihood that the spark plug 110 may cause firing or ignition failures frequently within the life of the gas engine. When an applied voltage reaches a predetermined level, the spark plug 110 can cause a spark discharge. This voltage level is generally referred to as a required voltage for the spark plug 110. According to the above test result, it is also found that the required voltage for the spark plug 110 possibly exceeds the level of a power voltage (e.g., approximately −35 kV) supplied from apower source to the spark plug 110. It is thus believed that this is a cause of the above-described firing or ignition failures.

Hereinafter, the cause of the above-identified firing or ignition failures will be described in greater detail.

According to the above-described conventional art, a bottom surface 1321*a* of the hole 1321 provided on the central electrode 103 is not securely connected to a distal end 1511 of the leg portion 151 of the chip 105 by welding. Accordingly, it is believed that the bottom surface 1321*a* of the hole 1321 is located adjacent to the distal end 1511 of the leg portion 151 with a tiny clearance between them. Otherwise, it is believed that the bottom surface 1321*a* of the hole 1321 abuts the distal end 1511 of the leg portion 151.

Due to manufacturing accuracies, tiny undulations of several tens $\mu$m are generally formed on the confronting surfaces of the central electrode 103 and the chip 105. Thus, even when the bottom surface 1321*a* of the hole 1321 is brought into contact with the distal end 1511 of the leg portion 151, unavoidable clearance or vacant space (i.e., air layer) of several tens $\mu$m exists between the bottom surface 1321*a* ofthe hole 1321 and the distal end 1511 of the leg portion 151. Therefore, a thermal conductivity is worsened at the boundary between the bottom surface 1321*a* of the hole 1321 and the distal end 1511 of the leg portion 151.

Accordingly, when the chip 105 receives heat during an operation of the spark plug 110, the heat cannot be effectively released or transferred from the chip 105 to the central electrode 103. The temperature of the chip 105 increases extraordinarily. The chip 105 may be worn out fatally. Thus, a discharge gap (6 in FIG. 2) of the spark plug 110 is increased rapidly. The above-described required voltage is increased correspondingly.

SUMMARY OF THE INVENTION

In view of the above-described problems, the present invention has an object of providing a novel spark plug having a central electrode and a chip with a leg portion and a larger-diameter portion, and preventing the chip from being detached or disengaged from the central electrode. Furthermore, the present invention has an object of effectively releasing or transferring heat from the chip to the central electrode. Yet further, the present invention has an object to provide a manufacturing method of the above-described novel spark plug.

In order to accomplish this and other related objects, the present invention provides an excellent spark plug and its manufacturing method whose various aspects will be described hereinafter. Reference numerals in parentheses added in the following description show the correspondence to the components described in preferred embodiments of the present invention. Reference numerals in parentheses are thus merely used for expediting the understanding to the present invention and not used for narrowly interpreting the scope of claims of the present invention.

An aspect of the present invention provides a spark plug comprising a central electrode (3) and a chip (5). A fused portion (7) is formed at a boundary between the front end portion **(3*a*) of the central electrode (3) and the chip (5). The central electrode (3) and the chip (5) are fused together for integrally connecting the central electrode (3) with the chip (5). The fused portion (7) is formed in such a manner that an entire periphery of a pointed end (71) of the fused portion (7) is positioned radially inside an outer cylindrical surface of the leg portion (51) of the chip (5)**.

With this arrangement, the fused portion (7) acts as a stopper means for preventing the chip (5) from removing or disengaging from the front end portion **(3*a*) of the central electrode (3), even if a bonding force between the fused portion (7) and the chip (5) is weak. Therefore, the life of the spark plug (10) can be extended so that the spark plug (10)** can be preferably applied to a gas engine.

It is preferable that the entire periphery of the pointed end (71) of the fused portion (7) penetrates into the leg portion (51) of the chip (5) in a radial direction by a degree equal to or larger than one tenth a diameter of the leg portion (51). This arrangement of the present invention is superior to the arrangement of the above-described prior art in that the chip (5) can be surely held by the central electrode (3), as demonstrated by the experiments and studies conducted by the inventors of the present invention.

Furthermore, it is preferable that the entire periphery of the pointed end (71) of the fused portion (7) penetrates into the leg portion (51) of the chip (5) in a radial direction by a length (L) equal to or larger than 0.2 mm. This arrangement of the present invention is superior to the arrangement of the above-described prior art in that the chip (5) can be surely held by the central electrode (3), as demonstrated by the experiments and studies conducted by the inventors of the present invention.

Preferably, the chip (5) is made of Ir or Ir alloy. For example, the central electrode (3) comprises an inner member (31) made of copper alloy and an outer member (32) made of nickel alloy.

The larger-diameter portion (52) of the chip (5) may have a diameter larger than that of the conventional art (in order to extend the life of the chip 5). More specifically, the larger-diameter portion (52) may have a diameter in a range of 2.5 mm to 3.5 mm. When the chip (5) having such a larger diameter is subjected to repetitive heating and cooling cycles in practical use, it is confirmed that a significant large temperature variation is caused between the larger-diameter portion (52) and the central electrode (3).

Accordingly, the above-described thermal stress will be increased. If the present invention is not employed, the chip (5) may be removed or disengaged from the fused portion (7) within a further short time. In other words, employing the present invention is effective to prevent the above-described detachment or disengagement of the chip (5). Accordingly, the life of the spark plug (10) can be extended effectively.

The spark plug (10) normally causes spark discharge at pointed or edged portions on the largerdiameter portion (52) of the chip (5). When such pointed or edged portions are worn out, the shape of the larger-diameter portion (52) of the chip (5) is rounded. The rounded chip (5) makes it difficult to cause the spark discharge smoothly. This increases the frequency of the firing or ignition failures. Thus, the life of the spark plug (10) is shortened. To solve this problem, it is preferable to form a groove (53) on a surface of the larger-diameter portion (52). A sharp edge portion (54) may be formed at a boundary between the groove (53) and the surface of the larger-diameter portion (52). With the provision of the above-described groove (53), the spark discharge can be easily caused at the edged portion (54). Therefore, the life of the spark plug (10) can be enlarged.

Furthermore, it is already confirmed that the chip (5) is subjected to a large temperature change due to repetitive heating and cooling cycles when the groove (53) is formed on the larger-diameter portion (52). However, by employing the present invention, the above-described detachment or disengagement of the chip (5) from the central electrode (3) can be effectively prevented.

An another aspect of the present invention provides a spark plug (10) comprising a chip (5) having a leg portion (51) and a larger-diameter portion (52). The leg portion (51) is inserted into a hole (321) provided on a front end portion **(3*a*) of a central electrode (3). A bottom portion (321*a*, 81) of the hole (321) of the central electrode (3) is integrally welded with a distal end (511) of the leg portion (51) of the chip (5). A fused portion (7) is provided at a boundary between the central electrode (3) and the chip (5) for integrally connecting the central electrode (3) with the chip (5). The fused portion (7) is formed by fusing the central electrode (3) and the chip (5)** together.

With this arrangement, the bottom portion **(321*a*, 81) of the hole (321) of the central electrode (3) is welded with the distal end (511) of the leg portion (51) of the chip (5). Through this welding operation, the tiny clearance no longer exists between the bottom portion (321*a*, 81) of the hole (321) and the distal end (511) of the leg portion (51). Thus, the thermal conductivity is improved between the bottom portion (321*a*, 81) of the hole (321) and the distal end (511) of the leg portion (51)**.

The central electrode (3) faces the chip (5) at a confronting surface. At this confronting surface, the temperature of the bottom portion **(321*a*, 81) of the hole (321) is lower than that of the cylindrical side surface of the hole (321). Improving the thermal conductivity between the bottom portion (321*a*, 81) and the distal end (511) of the leg portion (51) of the chip (5) is effective to release or transfer heat from the chip (5) to the central electrode (3)**.

Accordingly, extraordinary abrasion of the chip (5) can be eliminated. Increase of the required voltage of the spark plug (10) can be suppressed. Firing or ignition failures can be decreased. The life of the spark plug (10) can be extended. Thus, the spark plug (10) can be preferably employed in the above-described gas engine.

A bottom surface **(321*a*) of the hole (321) may constitute the bottom portion (321*a*. 81) of the present invention. Alternatively, an electrically conductive member (8) can be disposed on the bottom surface (321*a*) of the hole (321). A fusing point of the electrically conductive member (8) is lower than that of the chip (5). A surface (81) of the electrically conductive member (8) may also constitute the bottom portion (321*a*. 81)** of the present invention.

The fused portion (7) is formed by fusing the central electrode (3) and the chip (5). A thermal expansion coefficient of the fused portion (7) is somewhere between a thermal expansion coefficient of the central electrode (3) and a thermal expansion coefficient of the chip (5). Hence, the fused portion (7) can reduce a thermal stress occurring at the boundary between the central electrode (3) and the chip (5) during an operation of the spark plug (10). The detachment or disengagement of the chip (5) can be eliminated.

Preferably, the chip (5) is made of Ir (having a fusing point of approximately 2,454° C. and a thermal expansion coefficient of $6.8\times10^{-6}$ $deg^{-1}$) or Ir alloy (having a fusing point of approximately 2,000–2,400° C. and a thermal expansion coefficient of $7\times10^{-6}$–$8\times10^{-6}$ $deg^{-6}$). The fusing points of Ir and Ir alloy are further higher than that of Pt. Accordingly, adopting Ir or Ir alloy for the chip (5) is effective to extend the life of the spark plug (10).

Preferably, the central electrode (3) comprises an inner member (31) made of copper alloy (having a fusing point of approximately 1,080° C. and a thermal expansion coefficient of $16.5\times10^{-6}$ $deg^{-1}$) and an outer member (32) made of nickel alloy (having a fusing point of approximately 1,450° C. and a thermal expansion coefficient of $13.3\times10^{-6}$ $deg^{-6}$).

The larger-diameter portion (52) may have a diameter in a range of 2.5 mm to 3.5 mm. This diameter is larger than that of the above-described conventional chip. According to the spark plug (10) equipped with such a larger (long-life) chip (5), the temperature of the chip (5) tends to increase high during an operation of the spark plug (10). An abrasion of the chip (5) will increase. Thus, the life of the chip (5) is shortened unless the present invention is employed. However, by employing the present invention, the heat transfer from the chip (5) to the central electrode (3) can be improved. Extraordinary abrasion of the chip (5) can be effectively eliminated.

According to features of preferred embodiments of the present invention, the groove (53) is angularly offset from the fused portion (7) when seen from an axial direction of the chip (5). A plurality of fused portions (7) are provided along a cylindrical surface of the front end portion (3*a*) of the central electrode (3). The plurality of fused portions (7) are equally spaced at predetermined angular intervals (e.g., 90 degrees). The fused portion (7) is positioned at an intermediate height between a top and a bottom of the hole (321) of the central electrode (3).

Furthermore, another aspect of the present invention provides a manufacturing method for the above-described spark plug (10). The method comprises the following first and second steps. In the first step, the bottom portion (321*a,* 81) of the hole (321) of the central electrode (3) is welded with the distal end (511) of the leg portion (51) of the chip (5). Then, in the second step, the fused portion (7) is formed at the boundary between the central electrode (3) and the chip (5) after finishing the first step.

Preferably, a difference (L-D) is in a range of 0 to 0.1 mm when L represents a length of the leg portion (51) of the chip (5) and D represents a depth of the hole (321) of the central electrode (3). The first step is performed by welding the bottom portion (321*a,* 81) of the hole (321) with the distal end (511) of the leg portion (51), while the front end portion (3*a*) of the central electrode (3) is brought into contact with the larger-diameter portion (52).

When the difference between the length L and the depth D is 0, there is a possibility that a clearance or vacant space may be caused due to tiny size errors of the chip (5) and the central electrode (3) when the bottom portion (321*a,* 81) ofthe hole (321) ofthe central electrode (3) is united with the distal end (511) of the leg portion (51) of the chip (5) in the above-described first step. However, this problem can be solved by setting the difference (L-D) to be greater than 0.

When the difference (L-D) is larger than 1.0 mm, the leg portion (51) of the chip (5) may enter or extrude the bottom portion (321*a,* 81) of the hole (321) deeply. The front end portion (3*a*) of the central electrode (3) may be deformed by the leg portion (51). The deformed front end portion (3*a*) possibly expands or swells in the radial direction. Thus, the chip (5) may not be accurately disposed at a predetermined position on the central electrode (3). This is confirmed by the experiments conducted by the inventors of the present invention or known from their experiences.

When the chip (5) is dislocated from the above-described predetermined position, the chip (5) will be worn out locally, not uniformly. The discharge gap (6) will increase rapidly. This possibly causes a firing or ignition failure at an early stage. However, by setting the difference (L-D) to be lower than 1.0 mm, this problem can be eliminated.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENTS

Figure 1A:
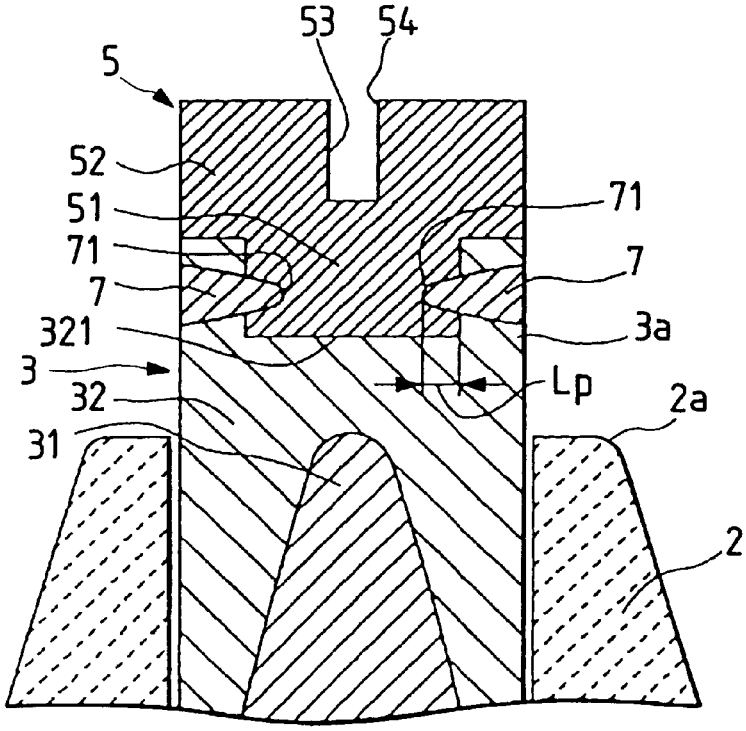
FIG. 1A is a cross-sectional view showing an end portion of a spark plug in accordance with a first embodiment of the present invention.

Preferred embodiments of the present invention will be explained hereinafter with reference to accompanied drawings. Identical parts are denoted by the same reference numerals throughout the drawings.

First embodiment

A first embodiment of the present invention will be explained with reference to FIGS. 1A, 1B and 2.

The spark plug 10 of the first embodiment is applied to a gas engine, such as a gas heat pump, using gaseous fuel (e.g., LNG, CNG etc.). As shown in FIG. 2, a metal fitting 1 is shaped into a cylindrical configuration. The metal fitting 1 comprises a screw portion 1*a* which is engageable with an engine block 100. The metal fitting 1 has an inside space for securely holding an insulator 2. The insulator 2 is made of alumina ceramic ($Al_2O_3$). The insulator 2 has an axial hole 21 extending in the axial direction of the insulator 2. A central electrode 3 is fixed in the axial hole 21. A front end 2*a* of the insulator 2 protrudes from a front end 11 of the metal fitting 1. Thus, the front end 2*a* of the insulator 2 is exposed to a combustion chamber 100*a l of the gas engine.*

As shown in FIG. 1A, the central electrode 3 has a cylindrical body consisting of an inner member 31 and an outer member 32. The inner member 31 is made of a metallic member (such as copper or copper alloy) having an excellent thermal conductivity. The outer member 32 is made of a Ni alloy member (e.g., Inconel 600 commercially available from Inconel Corp.) having an excellent heat resistivity. As shown in FIG. 2, the front end portion 3*a* of the central electrode 3 protrudes out of the front end 2*a* of the insulator 2. An earth electrode 4 is welded to the front end 11 of the metal fitting 1. The earth electrode 4 is made of a metallic member such as Ni alloy. A discharge gap 6 is provided between the earth electrode 4 and a later-described chip 5.

The pressure in the combustion chamber 100*a* of the gas engine is higher than that of a gasoline engine. In general, the spark discharge is not easily caused in a higher pressure environment. In view of the above, the discharge gap 6 of the spark plug 10 is set to an approximately 0.3 mm which is significantly shorter than the corresponding discharge gap of a spark plug used for a gasoline engine.

The chip 5, serving as an essential member of the present invention, is provided on the front end portion 3*a* of the central electrode 3. The chip 5 is made of Ir alloy (e.g., 90 wt % Ir−10 wt % Rh). A circular hole 321 is formed on the front end portion 3*a* of the central electrode 3. The chip 5 comprises a cylindrical leg portion 51 inserted and fitted into the circular hole 321. A larger-diameter portion 52 has a cylindrical configuration integral with the leg portion 51. A diameter of the larger-diameter portion 52 is larger than that of the leg portion 51.

Figure 1B:
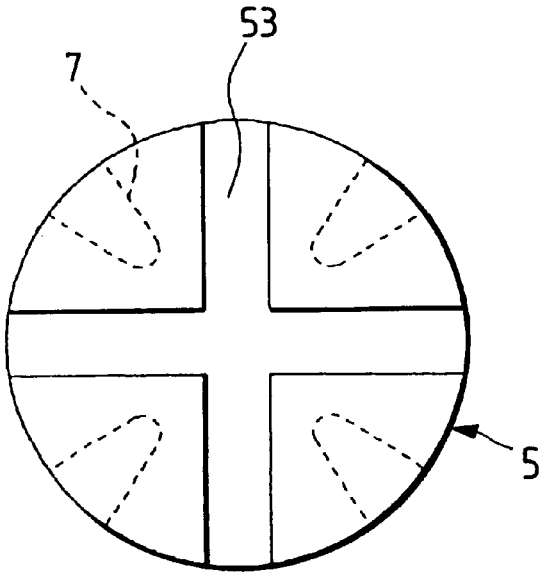
FIG. 1B is a plan view showing a chip of the spark plug in accordance with the first embodiment of the present invention.

A cross-shaped groove 53 is formed on the flat surface of the larger-diameter portion 52 as shown in FIG. 1B. The groove 53 has a rectangular cross section as shown in FIG. 1A. An edged portion 54 is formed at a boundary between the groove 53 and the flat (top) surface of the larger-diameter portion 52. An edge angle of the edged portion 54 is approximately 90 degrees. The spark discharge is caused in the discharge gap 6 chiefly at edged portions on the larger-iameter portion 52 of the chip 5 (e.g., at an outer cylindrical periphery of the larger-diameter portion 52 or the above-described edged portion 54). Accordingly, providing the groove 53 is effective to increase the places where the spark discharge occurs easily. The life of the spark plug 10 can be extended. During the spark discharge, flame occurs in the discharge gap 6. The space for forming the core of flame can be enlarged by providing the groove 53. The size of flame can be increased, too. As a result, firing or ignition of the fuel mixture can be improved.

A plurality of fused portions 7 are provided at the boundary between the leg portion 51 of the chip 5 and the front end portion 3*a* of the central electrode 3. Each fused portion 7 is formed by fusing both the leg portion 51 of the chip 5 and the front end portion 3*a* of the central electrode 3. According to this embodiment, a total of four fused portions 7 are equally spaced at angular intervals of 90°. Each fused portion 7 bridges the leg portion 51 of the chip 5 and the front end portion 3*a* of the central electrode 3. The fused portions 7 are formed by later-described laser welding. The fused portions 7 are angularly offset from the groove 53 when seen from an axial direction of the chip 5 as shown in FIG. 1B. An altitudinal position of each fused portion 7 is set to an intermediate height between the top of the hole 321 and the bottom of the hole 321.

The fused portion 7 extends in a radial direction of the chip 5. The entire periphery of a pointed end 71 penetrates radially inside the outer cylindrical surface of the leg portion 51 of the chip 5. A penetrating length Lp of the pointed end 71 of the fused portion 7 is, for example, 0.3 mm. The penetrating length Lp is defined as a radial length of the penetrating part of the pointed end 71 whose entire periphery is positioned inside the outer cylindrical surface of the leg portion 51 of the chip 5.

This arrangement is advantageous in that the fused portion 7 acts as a stopper for the chip 5, even if a bonding force between the fused portion 7 and the chip 5 is weak. Accordingly, it becomes possible to prevent the chip 5 from removing or disengaged from the front end portion 3*a* of the central electrode 3. The life of the spark plug 10 can be extended.

An evaluation was done for the configuration and dimensions of the fused portion 7 of the spark plug 10 in relation to the detachment of the chip 5. The result of this evaluation will be described hereinafter.

Prepared samples for the evaluation have the configuration shown in FIG. 1A. In each sample, the larger-diameter portion 52 has a diameter of 2.7 mm and an axial thickness of 1.3 mm. The leg portion 51 has a diameter of 1.7 mm and an axial thickness of 1.0 mm. The groove 53 has a width of 0.4 mm and a depth of 0.8 mm. When the chip 5 was welded to the central electrode 3, the penetrating length Lp was changed in three levels of 0.1 mm, 0.2 mm and 0.3 mm. A total of six samples were prepared for each penetrating length Lp of 0.1 mm, 0.2 mm and 0.3 mm. The conventional spark plug 10 shown in FIG. 8 was prepared, too. The noble metallic chip 5 and the central electrode 3 have the same dimensions as those described previously. A total of six samples of the conventional spark plug 10 were prepared.

Respective samples of the spark plugs 10 were subjected to repetitive heating-and-cooling cycles. More specifically, these samples were left in a 950° C. atmospheric environment for six minutes. Subsequently, these samples were left in a 25° C. environment for six minutes. This heating-and-cooling cycle was repeated continuously until the chip 5 was removed or disengaged from the central electrode 3. The total number of the performed heating-and-cooling cycles was measured as a cycle number required for the detachment of the chip 5.

According to the measured result, the detachment of the chip 5 of the conventional spark plug was confirmed after 100 to 130 heating-and-cooling cycles. On the other hand, the detachment of the chip 5 of the first embodiment was confirmed after 180 to 200 heating-and-cooling cycles for the samples having the penetrating length Lp=0.1 mm. No detachment of the chip 5 was found even after 400 heating-and-cooling cycles for the samples having the penetrating length Lp=0.2 mm or 0.3 mm.

Accordingly, the following facts was confirmed.

(1) The detachment of the chip 5 can be effectively eliminated when the entire periphery of the pointed end 71 of the fused portion 7 penetrates into the leg portion 51 of the chip 5.

(2) The detachment of the chip 5 can be effectively eliminated when the above-described penetrating length Lp of the pointed end 71 is equal to or larger than 0.2 mm.

Second embodiment

Figure 3:
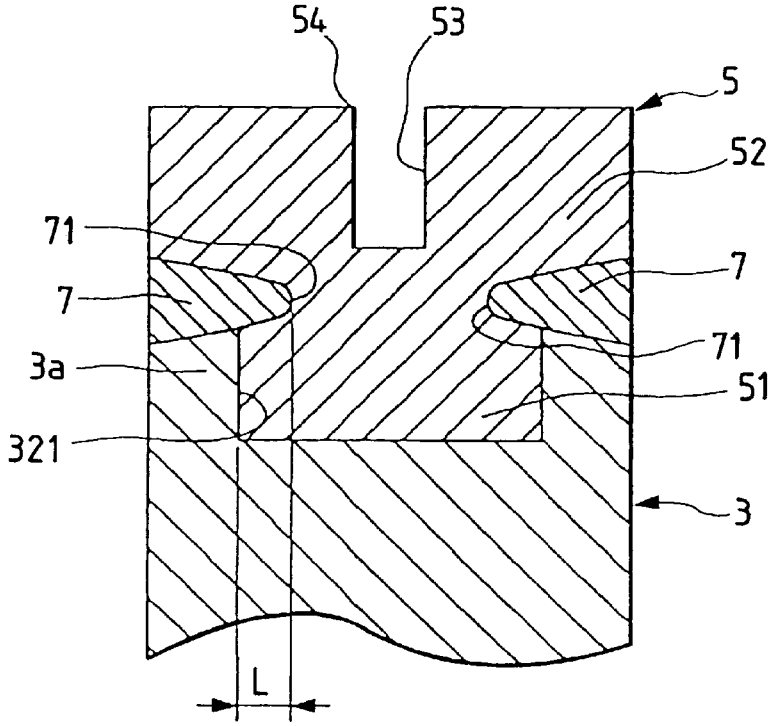
FIG. 3 is an enlarged cross-sectional view showing an end portion of a spark plug in accordance with a second embodiment of the present invention.

FIG. 3 shows a second embodiment of the present invention. According to the second embodiment, the fused portion 7 penetrates all of the front end portion 3*a* of the central electrode 3, the leg portion 51 of the chip 5 and the larger-diameter portion 52 of the chip 5. The entire periphery of the pointed end 71 of the fused portion 7 penetrates radially inside the outer cylindrical surface of the leg portion 51 of the chip 5. The penetrating length Lp of the pointed end 71 of the fused portion 7 is, for example, 0.3 mm.

Six samples of the second embodiment were prepared for each of the penetrating length Lp=0.1 mm, 0.2 mm and 0.3 mm. The above-described evaluation was conducted in the same manner for the samples of the second embodiment. The detachment of the chip 5 of the second embodiment was confirmed after 150 to 200 heating-and-cooling cycles for the samples having the penetrating length Lp=0.1 mm. No detachment of the chip 5 was found even after 400 heating-and-cooling cycles for the samples having the penetrating length Lp=0.2 mm or 0.3 mm.

Third embodiment

Figure 4:
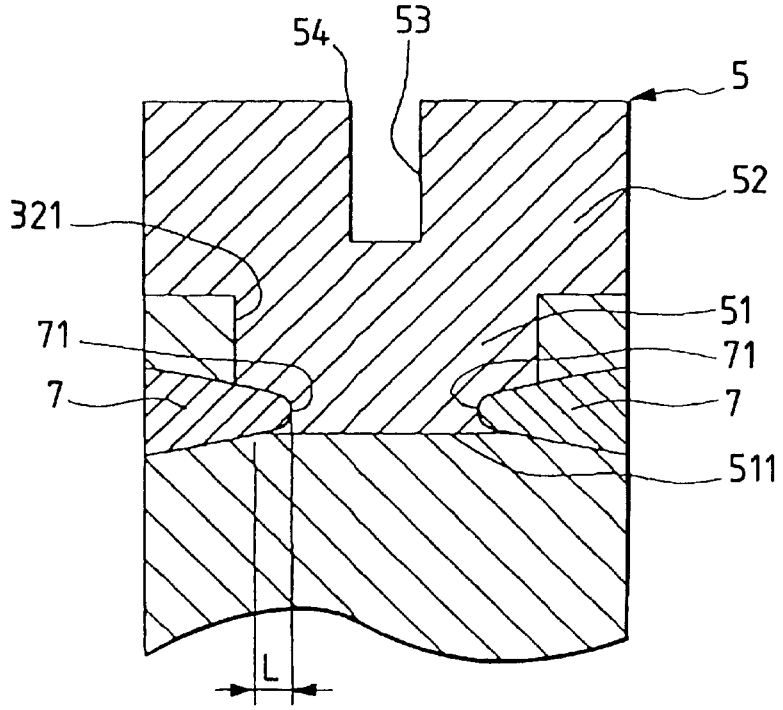
FIG. 4 is an enlarged cross-sectional view showing an end portion of a spark plug in accordance with a third embodiment of the present invention.

FIG. 4 shows a third embodiment of the present invention. According to the third embodiment, the fused portion 7 penetrates both of the front end portion 3*a* of the central electrode 3 and a bottom (distal end) 511 of the leg portion 51. The entire periphery of the pointed end 71 of the fused portion 7 penetrates radially inside the outer cylindrical surface of the leg portion 51 of the chip 5. The penetrating length Lp of the pointed end 71 of the fused portion 7 is, for example, 0.2 mm.

Six samples of the third embodiment were prepared for each of the penetrating length Lp=0.1 mm, 0.2 mm and 0.3 mm. The above-described evaluation was conducted in the same manner for the samples of the third embodiment. The detachment of the chip 5 of the third embodiment was confirmed after 150 to 200 heating-and-cooling cycles for the samples having the penetrating length Lp=0.1 mm. No detachment of the chip 5 was found even after 400 heating-and-cooling cycles for the samples having the penetrating length Lp=0.2 mm or 0.3 mm.

Fourth embodiment

Figure 2:
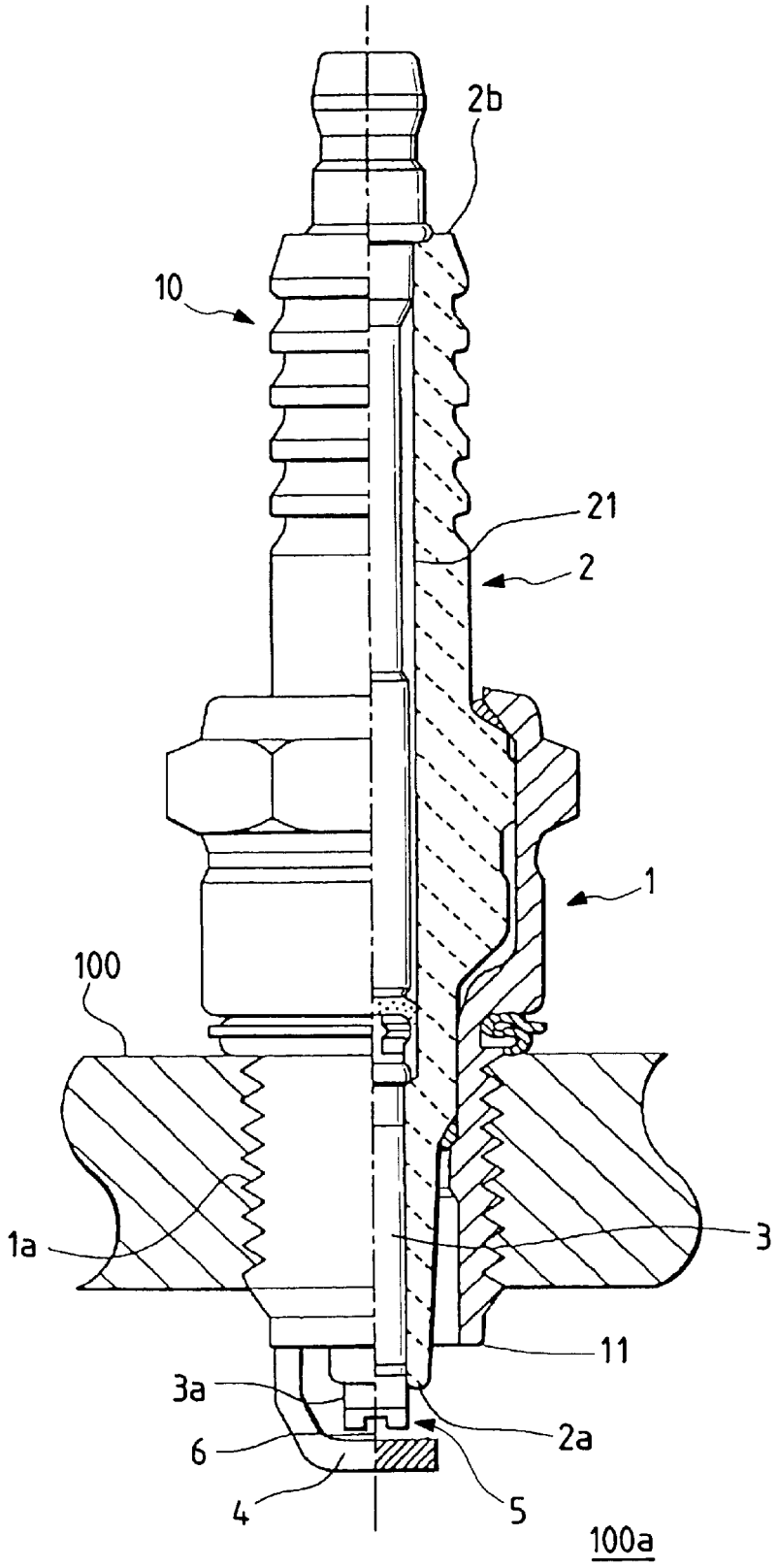
FIG. 2 is a partly sectional view showing an overall arrangement of the spark plug in accordance with the present invention.
Figure 5A:
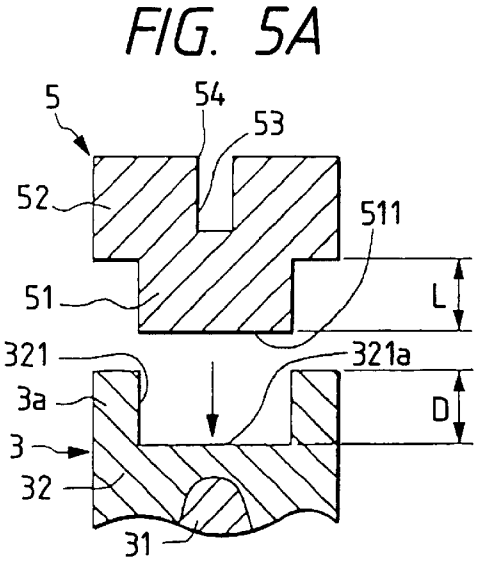
FIGS. 5A through 5D are cross-sectional views cooperatively showing a manufacturing method of the spark plug in accordance with a fourth embodiment of the present invention.
Figure 5B:
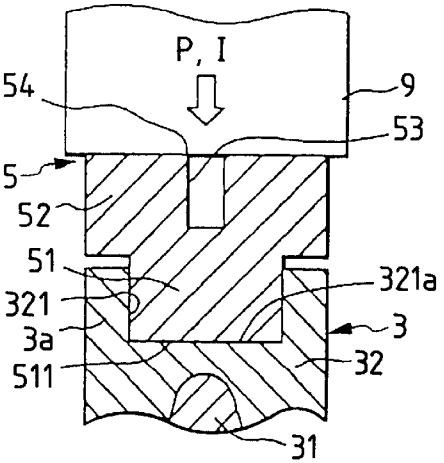
Figure 5C:
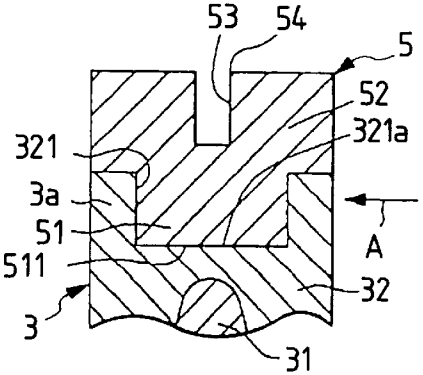
Figure 5E:
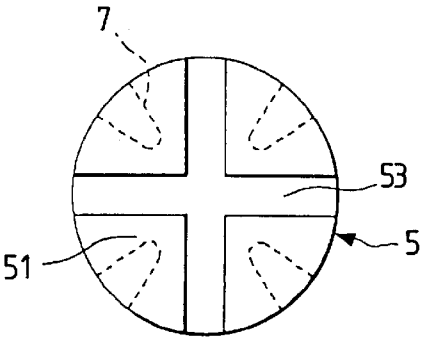
FIG. 5E is a plan view showing a chip of the spark plug in accordance with the fourth embodiment of the present invention.
Figure 5D:
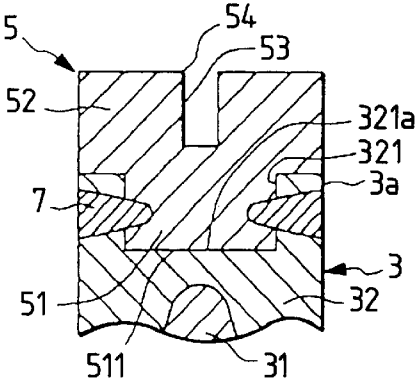

A spark plug 10 of a fourth embodiment of the present invention, shown in FIGS. 2, 5D and 5E, is applied to a gas engine, such as a gas heat pump.

The overall arrangement and dimensions of the spark plug 10, including the metal fitting 1, the insulator 2, the central electrode 3, the earth electrode 4, and the discharge gap 6, are identical with those disclosed in the first embodiment.

A chip 5 is provided on the front end portion 3*a* of the central electrode 3. The chip 5 is made of Ir alloy (e.g., 90 wt % Ir–10 wt % Rh). A circular hole 321 is formed on the front end portion 3*a* of the central electrode 3. The chip 5 comprises a circular leg portion 51 inserted and fitted into the circular hole 321. A larger-diameter portion 52 has a circular configuration integral with the leg portion 51. A diameter of the larger-diameter portion 52 is larger than that of the leg portion 51.

A cross-shaped groove 53 is formed on the flat surface of the larger-diameter portion 52 as shown in FIG. 5E. The groove 53 has a rectangular cross section as shown in FIG. 5A. An edged portion 54 is formed at a boundary between the groove 53 and the flat surface of the larger-diameter portion 52. An edge angle of the edged portion 54 is approximately 90 degrees. A plurality of fused portions 7 are provided at the boundary between the leg portion 51 of the chip 5 and the front end portion 3*a* of the central electrode 3. Each fused portion 7 is formed by fusing both the leg portion 51 of the chip 5 and the central electrode 3. According to this embodiment, a total of four fused portions 7 are equally spaced at angular intervals of 90°. Each fused portion 7 bridges the leg portion 51 of the chip 5 and the front end portion 3*a* of the central electrode 3. The fused portions 7 are formed by later-described laser welding.

The fused portion 7 are angularly offset from the groove 53 when seen from an axial direction of the chip 5. An altitudinal position of each fused portion 7 is set to an intermediate height between the top of the hole 321 and the bottom of the hole 321.

The fourth embodiment of the present invention provides a novel manufacturing method for the above-described spark plug 10. According to the manufacturing method of the fourth embodiment, the bottom surface (bottom portion) 321*a* of the hole 321 of the central electrode 3 is united or integrated with the distal end 511 of the leg portion 51 of the chip 5 by the resistance welding.

Hereinafter, a method for fixing the chip 5 to the front end portion 3*a* of the central electrode 3 will be explained.

First, as shown in FIG. 5A, the leg portion 51 of the chip 5 is inserted into the hole 321 of the central electrode 3. L represents a length of the leg portion 51 of the chip 5 and D represents a depth of the hole 321 of the central electrode 3. A difference (L-D) is set to be, for example, 0.4 mm. The largerdiameter portion 52 of the chip 5 has a diameter of 2.7 mm and an axial length of 1.3 mm. The groove 53 of the larger-diameter portion 52 has a width of 0.4 mm and a depth of 0.8 mm. The leg portion 51 has a diameter of 1.7 mm and the axial length L of 1.2 mm. The hole 321 of the central electrode 3 has a diameter of 1.8 mm and the depth D of 0.8 mm.

Next, as shown in FIG. 5B, a welding electrode 9 of a resistance welding machine is placed on the head of the chip 5 for performing a resistance welding. This resistance welding is performed under a pressure P=30 kg/cm$^2$ and a making current I=2,000 A. Using an alternating current, the resistance welding operation is repeated 30 cycles. Through this resistance welding, the distal end 511 of the leg portion 51 is entirely press fitted to the bottom surface 321*a* of the hole 321. A significant amount of heat is generated between the bottom surface 321*a* of the hole 321 and the distal end 511 of the leg portion 51 due to a large amount of current applied to them. With this heat, the bottom surface 321*a* of the hole 321 is entirely fused. The distal end 511 of the leg portion 51 extrudes or intrudes into the fused bottom of the hole 321.

Accordingly, as shown in FIG. 5C, the bottom surface 321*a* of hole 321 is entirely united or integrated with the distal end 511 of the leg 51. The larger-diameter portion 52 is brought into contact with the front end portion 3*a* of the central electrode 3. Thus, an extrusion amount of the above-described leg portion 51 into the fused bottom of the hole 321 is substantially regulated by the larger-diameter portion 52. The distal end 511 of the leg portion 51 may be slightly softened and deformed during the above-described resistance welding operation. Strictly speaking, the extrusion amount is slightly larger than the above-described difference (L-D).

Thereafter, the laser welding is applied at a plurality of portions (e.g., four spots) angularly spaced along a cylindrical side wall of the leg portion 51 of the chip 5. For the leaser welding, YAG laser (emitting an energy-concentrated beam) is preferably used. In this laser welding, irradiation energy is set to 5 J and irradiation time is 2.5 ms under a just focus condition. An arrow "A" shown in FIG. 5C indicates the laser irradiated in the radial direction.

According to the above-described arrangement, the bottom surface 321*a* of the hole 321 of the central electrode 3 is completely welded at its entire surface with the distal end 511 of the leg portion 51 of the chip 5. In other words, any tiny clearances or vacant spaces can be eliminated completely even if such clearances or vacant spaces exist between the bottom surface 321*a* of the hole 321 and the distal end 511 of the leg portion 51 due to manufacturing errors. Accordingly, the thermal conductivity between the bottom surface 321*a* of the hole 321 and the distal end 511 of the leg portion 51 can be improved.

The central electrode 3 faces the chip 5 at a confronting surface. At this confronting surface, the temperature of the bottom surface 321*a* of the hole 321 is lower than that of the cylindrical side surface of the hole 321. Improving the thermal conductivity between the bottom surface 321*a* and the distal end 511 of the leg portion 51 of the chip 5 is effective to release or transfer heat from the chip 5 to the central electrode 3 smoothly.

Accordingly, extraordinary abrasion of the chip 5 can be eliminated. Increase of the required voltage of the spark plug 10 can be suppressed. Firing or ignition failures can be reduced. The life of the spark plug 10 can be extended.

The fused portion 7 is formed by fusing the central electrode 3 and the chip 5. Thus, a thermal expansion coefficient of the fused portion 7 is somewhere between a thermal expansion coefficient of the central electrode 3 and a thermal expansion coefficient of the chip 5. Hence, the fused portion 7 can reduce a thermal stress occurring at the boundary between the central electrode 3 and the chip 5 during an operation of the spark plug 10. It becomes possible to prevent the chip 5 from detaching or disengaging from the front end portion 3*a* of the central electrode 3.

An evaluation was done for the difference (L-D) between the length L of the leg portion 51 and the depth D of the hole 321 in relation to the required voltage of the spark plug 10. The result of this evaluation will be described hereinafter.

Six samples of the spark plug 10 were prepared for each of designated dimensions −1.0 mm, −0.25 mm, 0.0 mm, 0.5 mm and 1.0 mm ofthe difference (L-D). In each sample, the chip 5 was fixed to the central electrode 3 by successively applying the above-described resistance welding and the laser welding.

Figure 6:
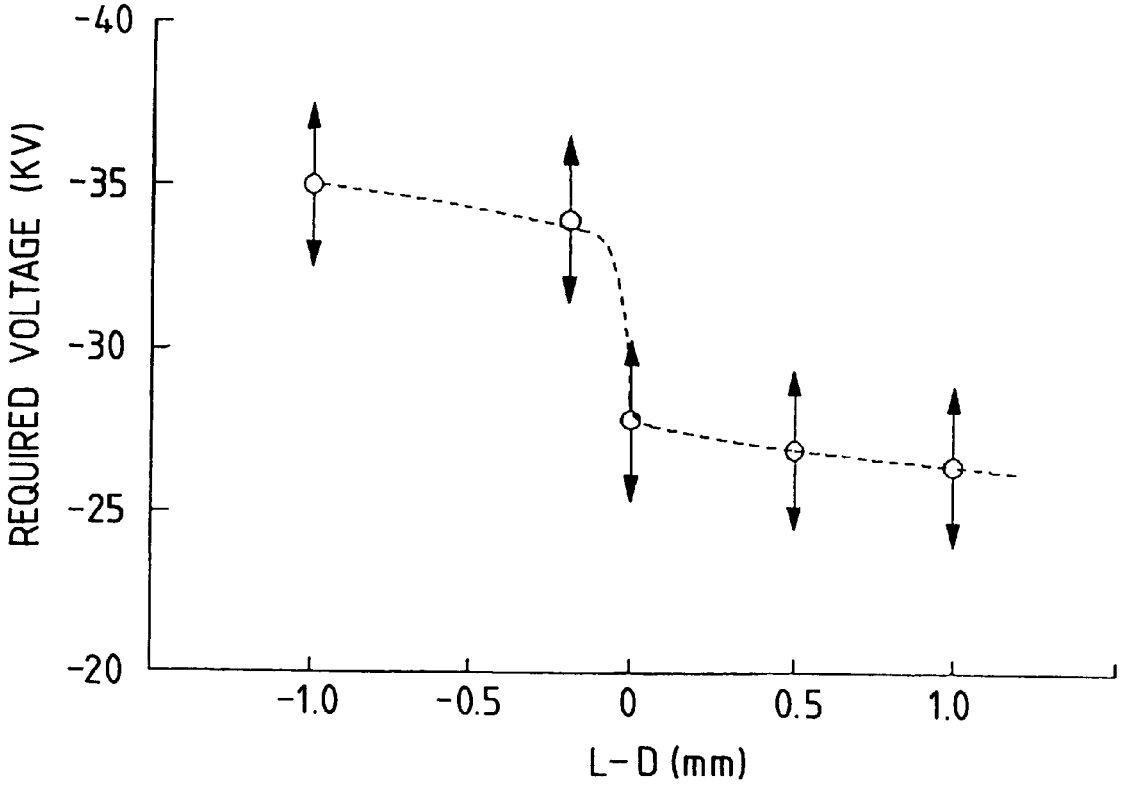
FIG. 6 is a graph showing a required voltage of the spark plug subjected to a 2,000 hour operation in a gas engine in relation to a difference (L-D) between the length L of a leg portion of the chip and the depth D of a hole opened on a central electrode of the spark plug.

Each spark plug 10 was installed on a gas engine of 12 cylinders and 4,500 cc. This gas engine was driven for 2,000 hours under a condition where a throttle was filly opened at an engine speed of 1,500 rpm. After this 2,000-hour operation, the required voltage of the spark plug 10 was measured. FIG. 6 shows the measurement result. In the graph of FIG. 6, each bidirectional arrow represents a dispersion range of the required voltage among the six samples of the spark plug 10. Each round mark represents an average of the required voltages in each group of the six samples. An initial required voltage was approximately −20 kV for all samples of the tested spark plug 10.

According to the test result, it was confirmed that the spark plugs 10 of the difference (L-D) of 0.0 mm, 0.5 mm and 1.0 mm was superior to the spark plugs 10 of the difference (L-D) of −1.0 mm and −0.25 mm. Increase of the required voltage was suppressed effectively. This leads to an extension of the life of the spark plug 10.

When the above-described difference (L-D) exceeds 1.0 mm, the front end portion 3*a* of the central electrode 3 deformed and swelled in the radial direction. In many of the tested samples of the spark plug 10, the chip 5 was not positioned accurately on the front end portion 3*a* of the central electrode 3.

When the difference (L-D) was −1.0 mm or −0.25 mm, the largerdiameter portion 52 of the chip 5 was strongly pressed to the front end portion 3*a* of the central electrode 3 during the resistance welding. The welding operation was done by chiefly causing heat at the pressed portion. Accordingly, it was failed to eliminate the clearance or vacant space between the distal end 511 of the leg portion 51 and the bottom surface 321*a* of the hole 321. It is thus believed that a resultant spark plug will be defective due to the bad heat transfer from the chip 5 to the central electrode 3.

Fifth embodiment

Figure 7:
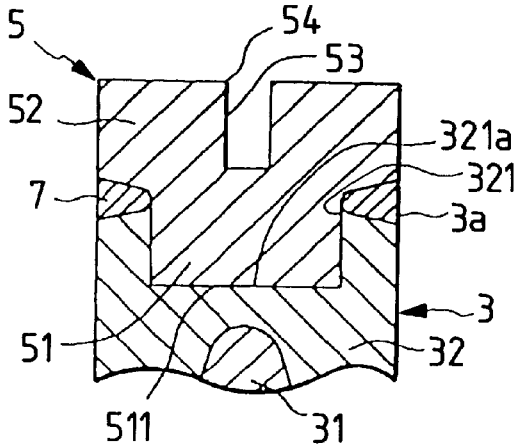
FIG. 7 is an enlarged cross-sectional view showing an end portion of a spark plug in accordance with a fifth embodiment of the present invention.

FIG. 7 shows a fifth embodiment of the present invention. According to the fifth embodiment, the fused portion 7 penetrates both the larger-diameter portion 52 of the chip 5 and the front end portion 3*a* of the central electrode 3. An evaluation substantially the same as the above-described evaluation was done on the spark plug 10 of the fifth embodiment. From reasons similar to those in the fourth embodiment, it was confirmed that preferable results were obtained when the above-described difference (L-D) was in the range of 0.0 mm to 1.0 mm.

Sixth embodiment

Figure 8A:
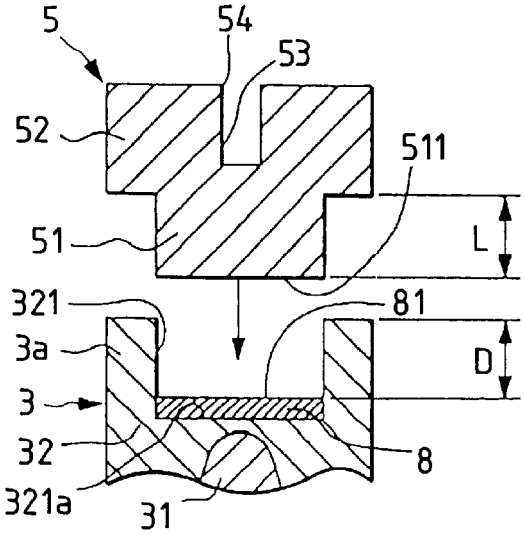
FIGS. 8A through 8D are cross-sectional views cooperatively showing a manufacturing method of a spark plug in accordance with a sixth embodiment of the present invention.
Figure 8B:
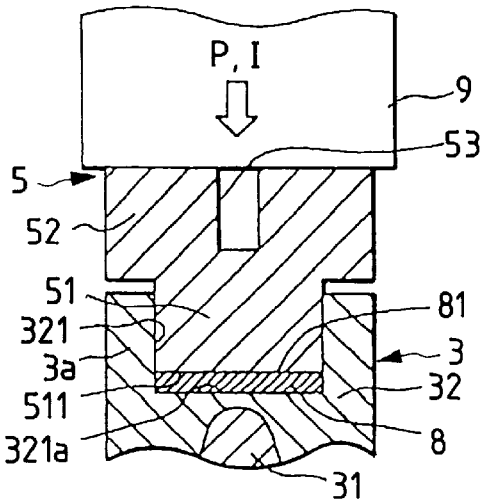

According to a sixth embodiment of the present invention, as shown in FIG. 8A, an electrically conductive member 8 having a cylindrical configuration is disposed on the bottom surface 321*a* of the hole 321 of the central electrode 3. Then, as shown in FIG. 8B, the resistance welding is performed under a 15 condition that the leg portion 51 pushes an upper surface 81 of the conductive member 8. The conductive member 8 is, for example, nickel alloy, Pt, or Ir alloy. A linear expansion coefficient of the conductive member 8 is somewhere between a linear expansion coefficient of the chip 5 and a linear expansion coefficient of the central electrode 3. A fusing point of the conductive member 8 is lower than a fusing point of the chip 5.

Figure 8C:
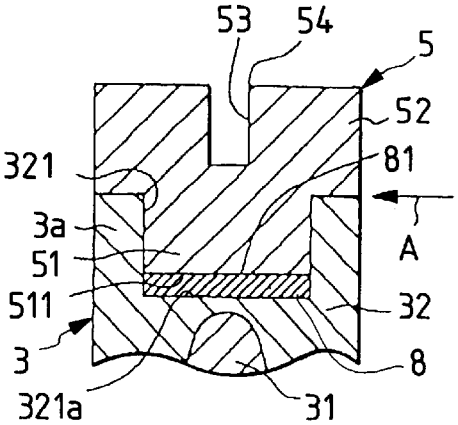
Figure 8D:
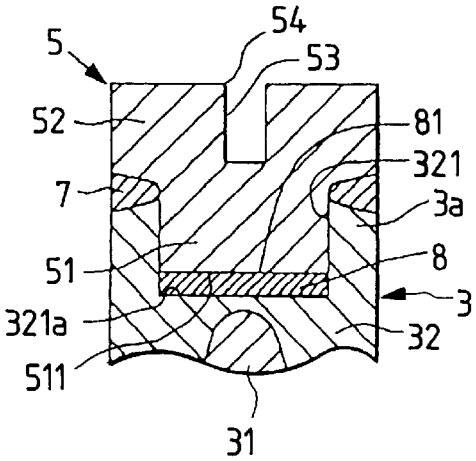
Figure 9:
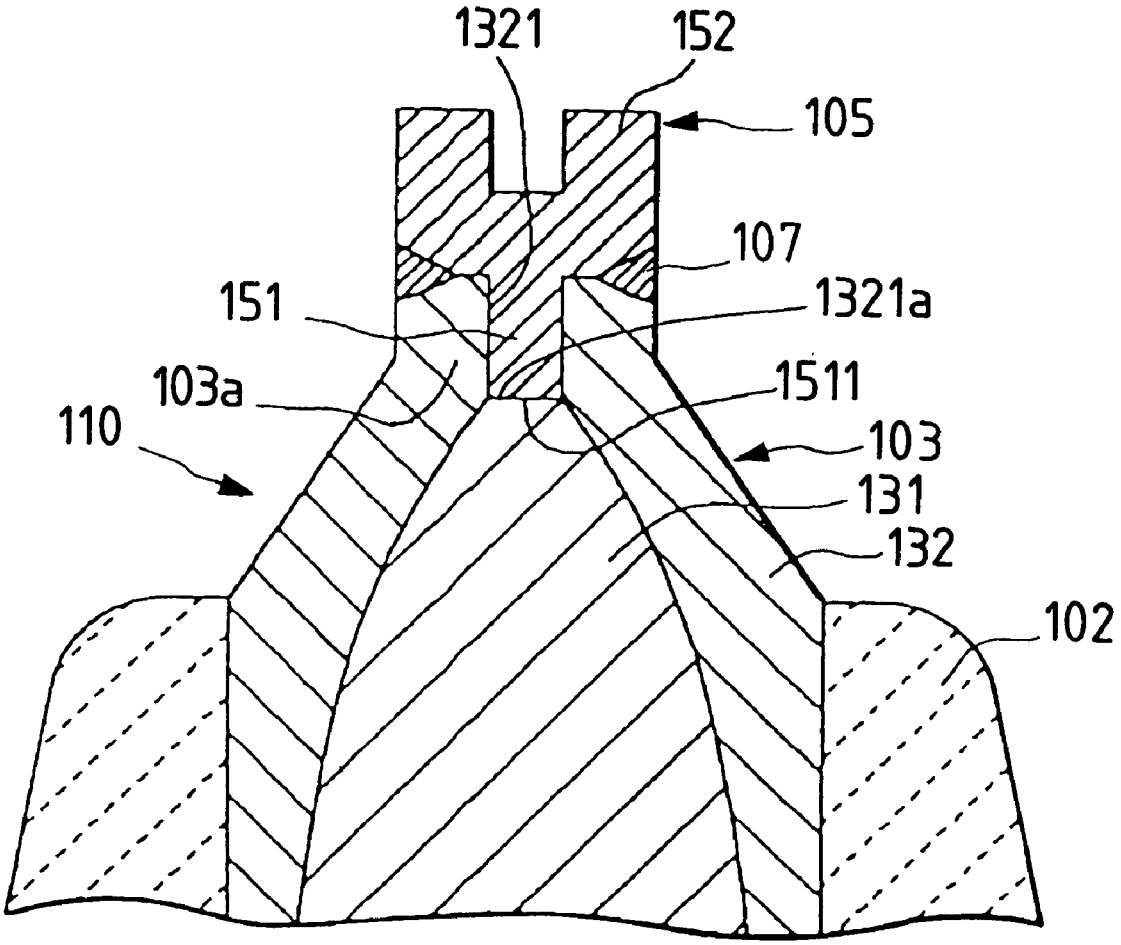
FIG. 9 PRIOR ART
FIG. 9 is an enlarged cross-sectional view showing an essential portion of a conventional spark plug.

The upper surface 81 of the conductive member 8 serves as the bottom portion of the hole 321 defined in the present invention. The length from the front end surface of the central electrode 3 to the upper surface 81 of the conductive member 8 is defined as the depth D of the hole 321 defined in the present invention. The difference (L-D) between the depth D of the hole 321 and the length L of the leg portion 51 is, for example, set to 0.8 mm. The bottom surface 321*a* of the hole 321 and the conductive member 8 are chiefly fused during the above-described resistance welding operation. As shown in FIG. 8C, the bottom surface 321*a* of the hole 321 is united or integrated with the bottom of the conductive member 8. The upper surface 81 of the conductive member 8 is united or integrated with the distal end 511 of the leg portion 51. Subsequently, the laser beam is irradiated in the direction indicated by the arrow A in FIG. 8C. Thus, the fused portion 7 is formed as shown in FIG. 8D.

According to the above-described arrangement, not only the fused portion 7 but the conductive member 8 act as the means for effectively reducing the thermal stress acting at the boundary between the chip 5 and the central electrode 3. It becomes possible to effectively prevent the chip 5 from detaching or disengaging from the central electrode 3.

Various modifications

According to the above-described embodiments, the larger-diameter portion 52 is formed with the cross-shaped groove 53. However, the configuration of the groove 53 is not limited to the above-described one. Thus, the groove 53 may have a circular or spoke-like configuration. It is also possible to eliminate the groove 53.

Furthermore, according to the above-described embodiments, the groove 53 has a rectangular cross section. However, the cross section of the groove 53 can be modified into a V-shaped configuration. The edge angle of the edged portion 54 can be flexibly increased or decreased.

Still further, according to the above-described embodiments, the larger-diameter portion 52 has a diameter of 2.7 mm. However, the diameter of the larger-diameter portion 52 can be changed flexibly. For example, the diameter of the larger-diameter portion 52 can be equalized to that (1.8 mm) of the larger-diameter portion 152 of the above-described conventional chip 105.

Yet further, according to the above-described embodiments, the laser beam was used as the energy-concentrated beam. However, it is also possible to use an electron beam or the like.

Moreover, according to the above-described fourth embodiment, the front end portion 3*a* of the central electrode 3 was brought into contact with the larger-diameter portion 52 as shown in FIG. 5C. With this arrangement, the above-described extrusion amount was substantially regulated to the predetermined value L-D). However, instead of bringing the larger-diameter portion 52 into contact with the front end portion 3*a* of the central electrode 3, it is possible to adjust the making current I or the pressure P for the resistance welding operation so as to control the extrusion amount. Through this power control, the extrusion amount can be equalized to the predetermined value (L-D). In this case, the length L of the leg portion 51 and the depth D of the hole 321 may satisfy a relationship that the difference (L-D) is larger than 1.0 mm.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A spark plug comprising:

a central electrode made of an electrically conductive member, said central electrode having a front end portion provided with a hole;

a chip having a leg portion inserted in said hole and a larger-diameter portion larger in diameter than said leg portion, said leg portion being integral and coaxial with said larger-iameter portion, a fusing point of said chip being higher than a fusing point of said central electrode, and a thermal expansion coefficient of said chip being smaller than a thermal expansion coefficient of said central electrode;

a fused portion provided at a boundary between said front end portion of said central electrode and said chip for integrally connecting said central electrode with said chip, said fused portion being formed by fusing said central electrode and said chip together; and a pointed end of said fused portion having an entire periphery positioned radially inside an outer cylindrical surface of said leg portion of said chip.

2. The spark plug in accordance with claim 1, wherein the entire periphery of said pointed end of said fused portion penetrates into said leg portion of said chip in a radial direction by a degree equal to or larger than one tenth a diameter of said leg portion.

3. The spark plug in accordance with claim 1, wherein the entire periphery of said pointed end of said fused portion penetrates into said leg portion of said chip in a radial direction by an amount equal to or larger than 0.2 mm.

4. The spark plug in accordance with claim 1, wherein said chip is made of Ir or Ir alloy.

5. The spark plug in accordance with claim 1, wherein said central electrode comprises an inner member containing copper and an outer member containing nickel.

6. The spark plug in accordance with claim 1, wherein said fused portion penetrates all of said central electrode, said leg portion of said chip and said larger-diameter portion of said chip.

7. The spark plug in accordance with claim 1, wherein said fused portion penetrates only said central electrode and said leg portion of said chip.

8. The spark plug in accordance with claim 1, wherein said larger-diameter portion has a diameter in a range of 2.5 mm to 3.5 mm.

9. The spark plug in accordance with claim 1, wherein a groove is formed on a surface of said larger-diameter portion, and a sharp edged portion is formed at a boundary between said groove and the surface of said largerdiameter portion.

10. The spark plug in accordance with claim 9, wherein said groove is angularly offset from said fused portion when seen from an axial direction of said chip.

11. The spark plug in accordance with claim 1, wherein a plurality of fused portions are provided along a cylindrical surface of said front end portion of said central electrode.

12. The spark plug in accordance with claim 11, wherein said plurality of fused portions are equally spaced at predetermined angular intervals.

13. The spark plug in accordance with claim 1, wherein said fused portion is positioned at an intermediate height between a top and a bottom of said hole of said central electrode.

14. A spark plug comprising:

a central electrode made of an electrically conductive member, said central electrode having a front end portion provided with a hole;

a chip having a leg portion inserted in said hole and a larger-diameter portion larger in diameter than said leg portion, said leg portion being integral and coaxial with said larger-diameter portion, and a fusing point of said chip being higher than a fusing point of said central electrode;

a bottom portion of said hole of said central electrode being integrally welded with a distal end of said leg portion of said chip; and a fused portion provided at a boundary between said central electrode and said chip for integrally connecting said central electrode with said chip, said fused portion being formed by fusing said central electrode and said chip together.

15. The spark plug in accordance with claim 14, wherein said chip is made of Ir or Ir alloy.

16. The spark plug in accordance with claim 14, wherein said central electrode comprises an inner member containing copper and an outer member containing nickel.

17. The spark plug in accordance with claim 14, wherein said fused portion penetrates said central electrode and said leg portion of said chip.

18. The spark plug in accordance with claim 14, wherein said fused portion penetrates said central electrode and said larger-diameter portion of said chip.

19. The spark plug in accordance with claim 14, wherein said larger-diameter portion has a diameter in a range of 2.5 mm to 3.5 mm.

20. The spark plug in accordance with claim 14, wherein a groove is formed on a surface of said larger-diameter portion, and a sharp edged portion is formed at a boundary between said groove and the surface of said larger-diameter portion.

21. The spark plug in accordance with claim 20, wherein said groove is angularly offset from said fused portion when seen from an axial direction of said chip.

22. The spark plug in accordance with claim 14, wherein a plurality of fused portions are provided along a cylindrical surface of said front end portion of said central electrode.

23. The spark plug in accordance with claim 22, wherein said plurality of fused portions are equally spaced at predetermined angular intervals.

24. The spark plug in accordance with claim 14, wherein said fused portion is positioned at an intermediate height between a top and a bottom of said hole of said central electrode.

25. A manufacturing method for a spark plug comprising:

a first step of welding a bottom portion of a hole opened on a central electrode with a distal end of a leg portion of a chip; and a second step of forming a fused portion at a boundary between said central electrode and said chip after finishing said first step.

26. The manufacturing method for the spark plug in accordance with claim 25, wherein an electrically conductive member is disposed on the bottom portion of said hole of said central electrode in said first step, a fusing point of said electrically conductive member is lower than a fusing point of said chip, and said first step is performed by welding a surface of said electrically conductive member with said distal end of said leg portion of said chip.

27. The manufacturing method for the spark plug in accordance with claim 25, wherein a difference (L-D) is in a range of 0 to 0.1 mm when L represents a length of said leg portion of said chip and D represents a depth of said hole of said central electrode, and said first step is performed by welding said bottom portion of said hole with said distal end of said leg portion, while said front end portion of said central electrode is brought into contact with a larger-diameter portion of said chip.

28. The manufacturing method for the spark plug in accordance with claim 25, wherein said front end portion of said central electrode is integrated with said distal end of said leg portion of said chip by resistance welding.

29. The manufacturing method for the spark plug in accordance with claim 25, wherein said fused portion is formed by irradiating an energy-concentrated beam to the boundary between said central electrode and said chip.

* * * * *